US011019885B2

(12) United States Patent
Bartels et al.

(10) Patent No.: US 11,019,885 B2
(45) Date of Patent: Jun. 1, 2021

(54) MANUFACTURING SYSTEMS AND PROCESSES FOR CONSTRUCTING ARTICLES OF FOOTWEAR USING SACRIFICIAL STRAPS

(71) Applicant: NIKE, Inc., Beaverton, OR (US)

(72) Inventors: Rita M. Bartels, Gresham, OR (US); Eric Joseph Marshall, Tualatin, OR (US)

(73) Assignee: NIKE, Inc., Beaverton, OR (US)

( * ) Notice: Subject to any disclaimer, the term of this patent is extended or adjusted under 35 U.S.C. 154(b) by 17 days.

(21) Appl. No.: 16/422,016

(22) Filed: May 24, 2019

(65) Prior Publication Data

US 2019/0357634 A1 Nov. 28, 2019

Related U.S. Application Data

(60) Provisional application No. 62/676,572, filed on May 25, 2018.

(51) Int. Cl.

| | |
|---|---|
| ***A43D 86/00*** | (2006.01) |
| ***A43D 3/02*** | (2006.01) |
| ***A43B 9/02*** | (2006.01) |
| ***A43B 13/28*** | (2006.01) |

(Continued)

(52) U.S. Cl.

CPC ..... *A43D 86/00* (2013.01); *A43B 9/02* (2013.01); *A43B 13/28* (2013.01); *A43B 21/36* (2013.01); *A43D 3/022* (2013.01); *A43D 11/00* (2013.01)

(58) Field of Classification Search

CPC ..... A43D 3/022; A43D 3/028; A43D 3/029; A43D 9/00; A43D 11/006; A43D 11/00; A43D 11/08; A43D 86/00; A43B 9/02; A43B 13/28; A43B 21/36

See application file for complete search history.

(56) References Cited

U.S. PATENT DOCUMENTS

| | | | | |
|---|---|---|---|---|
| 817,373 A * | 4/1906 | Jones | ..... | A43D 9/00 12/107 R |
| 828,300 A * | 8/1906 | Bott | ..... | A43D 9/00 12/107 R |
| 914,376 A | 3/1909 | Baker | | |

(Continued)

FOREIGN PATENT DOCUMENTS

FR 2037514 A5 12/1970

*Primary Examiner* — Ted Kavanaugh

(74) *Attorney, Agent, or Firm* — Quinn IP Law

(57) ABSTRACT

Presented are systems, methods, and devices for manufacturing articles of footwear using sacrificial straps to secure segments of the footwear to a manufacturing fixture. A method for manufacturing an article of footwear, such as an athletic shoe, includes providing first and second segments of the footwear's upper, such as the vamp and heel counter. A sacrificial strap is removably attached at opposing ends thereof to the first segment, e.g., proximate a read edge of the vamp. The first segment is placed on a manufacturing fixture, such as a foot-shaped last, and securely attached to the fixture by positioning the sacrificial strap around and against the fixture. The second segment of the upper is attached, e.g., via stitching or bonding, to the first segment. Once attached, the upper is removed from the manufacturing fixture, and the sacrificial strap is cut, torn or otherwise permanently disconnected from the footwear.

20 Claims, 2 Drawing Sheets

(51) Int. Cl.
*A43B 21/36* (2006.01)
*A43D 11/00* (2006.01)

(56) References Cited

U.S. PATENT DOCUMENTS 914,377 A 3/1909 Baker
1,415,951 A * 5/1922 Pym ..... A43D 9/00 12/107 A
1,440,898 A * 1/1923 Sorensen ..... A43D 9/00 12/107 R
1,561,669 A 11/1925 Stewart
1,719,279 A 7/1929 Shliekr
1,825,276 A 9/1931 Hollier
1,975,460 A 10/1934 Hope
1,985,310 A 12/1934 Brauer et al.
1,985,311 A 12/1934 Brauer
1,987,637 A 1/1935 Pym
2,010,092 A * 8/1935 Lawson ..... A43D 9/00 12/145
2,234,544 A * 3/1941 Ashworth ..... A43D 113/00 12/103
2,301,295 A 11/1942 Lafferty
2,394,206 A * 2/1946 Robinson ..... A43D 9/00 12/107 A
2,409,721 A * 10/1946 Spack ..... A43D 11/00 12/107 R
2,654,904 A 10/1953 Hollier
2,955,326 A 10/1960 Murray
3,131,490 A * 5/1964 Rowen ..... A43D 11/08 36/1
3,228,049 A 1/1966 Sbicca
3,298,050 A 1/1967 Batchelder et al.
3,525,110 A 8/1970 Batchelder et al.
5,152,025 A 10/1992 Hirmas
5,449,005 A 9/1995 Echols

* cited by examiner

MANUFACTURING SYSTEMS AND PROCESSES FOR CONSTRUCTING ARTICLES OF FOOTWEAR USING SACRIFICIAL STRAPS

CLAIM OF PRIORITY AND CROSS-REFERENCE TO RELATED APPLICATION

This application claims the benefit of and priority to U.S. Provisional Patent Application No. 62/676,572, which was filed on May 25, 2018, and is incorporated herein by reference in its entirety and for all purposes.

TECHNICAL FIELD

The present disclosure relates generally to methods for manufacturing articles of footwear. More specifically, aspects of this disclosure relate to mechanical features for retaining segments of an article of footwear on a last during assembly of the footwear.

BACKGROUND

Articles of footwear, such as shoes, boots, slippers, sandals, and the like, are generally composed of two primary elements: an upper for securing the footwear to a user's foot; and a sole for providing subjacent support to the foot. Uppers may be fabricated from a variety of materials, including textiles, foams, polymers, natural and synthetic leathers, etc., that are stitched or bonded together to form a shell or harness for securely receiving a foot. For sandals and slippers, the upper may have an open toe or open heel construction, or may be generally limited to a series of straps extending over the instep and, in some designs, around the user's ankle. Conversely, boot and shoe applications typically employ a full upper with a closed toe and heel construction that encases the foot. An ankle opening through a rear quarter portion of the upper provides access to the footwear's interior, facilitating entry and removal of the foot into and from the upper. A lace or strap may be utilized to secure the foot within the upper.

A sole structure is generally attached to the underside of the upper, positioned between the user's foot and the ground. In many articles of footwear, including athletic shoes and boots, the sole structure is a layered construction that generally incorporates a comfort-enhancing insole, an impact-mitigating midsole, and a surface-contacting outsole. The insole, which may be located partially or entirely within the upper, is a thin and compressible member that provides a contact surface for the underside "plantar" region of the user's foot. By comparison, the midsole is mounted underneath the insole, forming a middle layer of the sole structure. In addition to attenuating ground reaction forces, the midsole may help to control foot motion and impart enhanced stability. Secured to the underside of the midsole is an outsole that forms the ground-contacting portion of the footwear. The outsole is usually fashioned from a durable, wearproof material that includes tread patterns engineered to improve traction.

Available techniques for fabricating an article of footwear may begin with interconnecting the individual pieces of material that form a forward "vamp" portion of the footwear's upper. An optional inner liner may then be joined to the interior surfaces of one or more exterior panels of the vamp. For designs where the vamp is formed separate from the toe box, a matching toe cap is stitched or bonded to the foreword end of the vamp. This pre-constructed assembly is then seated on a complementary fixture—more commonly known as a "last"—that has the general shape of a human foot. Historically, a pin, clip, shim, or spring-biased tang is used to temporarily fasten the assembly to the last. An assortment of processes may then be utilized to tighten the upper around the last, thereby imparting the foot-shaped contour of the last to the interior of the upper. In order to conform the upper of an athletic shoe around a last, for example, a strobel material may be secured to a lower perimeter of the upper and stretched across an area of the last corresponding to the plantar surface of the foot. A heel counter is affixed to a rearward end of the vamp, and the sole structure is secured to the underside of the upper to generally enclose the strobel between the upper and sole structure.

SUMMARY

Presented herein are methods for constructing articles of footwear using sacrificial straps to secure segments of the footwear to a manufacturing fixture, shoe structure segments prefabricated with such sacrificial straps, systems for manufacturing articles of footwear using sacrificial straps, and methods for operating such systems. By way of example, there is presented a manufacturing process workflow for fabricating an athletic shoe using a sacrificial heel strap to temporarily secure the forward vamp and attached strobel to a last. Upon completing the manufacturing procedure or procedures associated with the last, such as attachment of the heel counter and sole structure to the vamp, the sacrificial heel strap is permanently removed. In this example, the sacrificial heel strap may generally consist of a thin, elongated strip of material that is removably attached at opposing ends thereof proximal the welt line of the vamp. This sacrificial heel strap may be formed from a material that is different from and structurally inferior to that of the other segments of the shoe. The material may be frangible, easily cut, or fabricated with features to facilitate removal of the strap, such as a tear seam or micro-slots. In addition, the heel strap may be configured to fit inside the upper, e.g., adjacent a heel cap/rear quarter of the shoe structure, yet be readily accessible for ease of removal of the strap once the shoe is pulled from the last.

Aspects of this disclosure are directed to manufacturing processes for constructing footwear. In an example, a method is presented for manufacturing an article of footwear for a foot of a user. This representative method includes, in any order and in any combination with any of the above or below disclosed features and options: providing a first segment of an upper, wherein the upper is configured to attach to the user's foot and includes a sacrificial strap that is attached at opposing ends thereof to the first segment; placing the first segment of the upper on a manufacturing fixture; attaching the first segment to the manufacturing fixture by positioning the sacrificial strap against the manufacturing fixture; attaching a second segment of the upper to the first segment; removing the first and second segments from the fixture; and disconnecting the sacrificial strap from the upper.

In another example, a method is presented for assembling an athletic shoe. This representative method includes, in any order and in any combination with any of the above or below disclosed features and options: providing a foot-shaped last with a forefoot region, a heel region, and a midfoot region interposed between and adjoining the heel and forefoot regions; placing a vamp segment of the athletic shoe's upper, e.g., with an attached strobel, on at least the forefoot region of the last, the upper including a sacrificial strap that is removably attached at opposing ends thereof proximate a rear edge of the vamp; temporarily attaching the vamp to the last by positioning the sacrificial strap around and against at least the heel region of the last; attaching a heel counter to the vamp, e.g., via stitching, bonding, or other suitable means; attaching a sole structure of the athletic shoe to the vamp and heel counter, e.g., via welting, foxing, or other suitable means; after attaching the heel counter and sole structure to the vamp, removing the vamp, heel counter and sole structure from the last; and, after removing the assembled athletic shoe from the last, tearing or cutting the sacrificial strap from the upper.

Further aspects of the disclosure are directed to pre-assembled segments of an article of footwear with sacrificial straps. For instance, an article of footwear includes an upper that receives and attaches to a foot of a user. The upper is fabricated with a vamp, a heel counter that rigidly attaches to the vamp, and a sacrificial strap that nests inside the heel counter and removably attaches at opposing ends thereof proximate a rear edge of the vamp. The article of footwear also includes a sole structure that attaches to a lower portion of the upper and supports thereon the user's foot. The sole structure includes an outsole that defines the ground-engaging portion of the footwear. After assembling the footwear, the sacrificial strap is configured to be permanently disconnected from upper.

Other aspects of the present disclosure are directed to manufacturing systems for constructing an article of footwear. In an example, a footwear manufacturing system includes a flat machine that constructs a first segment of an upper with a sacrificial strap that is attached at opposing ends thereof to the first segment. The manufacturing system also includes a last with a foot-shaped section that seats thereon the various segments of the upper. One or more of these segments may be mechanically attached to the last by positioning the sacrificial strap against the last. After being securely attached to the last, the segments of the upper are rigidly attached to each other. A finishing bench receives the attached segments of the upper such that the sacrificial strap can be permanently removed from the upper.

For any of the disclosed systems, methods, and devices, disconnecting the sacrificial strap from the upper may include cutting the sacrificial strap off of the first segment. To facilitate removal, the sacrificial strap may be fabricated from a polymeric material and/or textile material, both of which are configured to be readily cut, e.g., by a pair of manually operated scissors. Optionally, the sacrificial strap may be fabricated with a reduced-thickness section and/or a slotted section, both of which facilitate cutting the strap. Alternatively, disconnecting the sacrificial strap from the upper may include tearing the sacrificial strap off of the first segment. To facilitate removal by tearing, the sacrificial strap may be fabricated from a frangible material that is configured to be readily torn. Optionally, the sacrificial strap may be fabricated with a tear seam that includes a series of apertures and/or micro-slots that facilitate tearing of the strap.

For any of the disclosed systems, methods, and devices, the first segment may be fabricated with a first material while the sacrificial strap is fabricated with a second material that is distinct from the first material of the first segment. As another option, the sacrificial strap may consist essentially of an elongated, single-piece sling that is bonded or stitched to the first segment. In other words, the sacrificial strap may be characterized by a lack of a buckle, buckle through holes, surface finishing, interior lining, and other features characteristic of permanent straps used for sandals, high-heeled shoes, etc. As indicated above, the first segment of the upper to which the sacrificial strap is attached may be a vamp segment of the upper; however, it is envisioned that sacrificial straps may be attached to other segments of the shoe structure to facilitate assembly of the footwear. For instance, the first and second segments discussed above may include a vamp segment, a strobel segment attached to the vamp segment, and/or a heel counter segment.

The above summary is not intended to represent every embodiment or every aspect of the present disclosure. Rather, the foregoing summary merely provides an exemplification of some of the novel concepts and features set forth herein. The above features and advantages, and other features and attendant advantages of this disclosure, will be readily apparent from the following detailed description of illustrated examples and representative modes for carrying out the present disclosure when taken in connection with the accompanying drawings and the appended claims. Moreover, this disclosure expressly includes any and all combinations and subcombinations of the elements and features presented above and below.

Figure 1A:
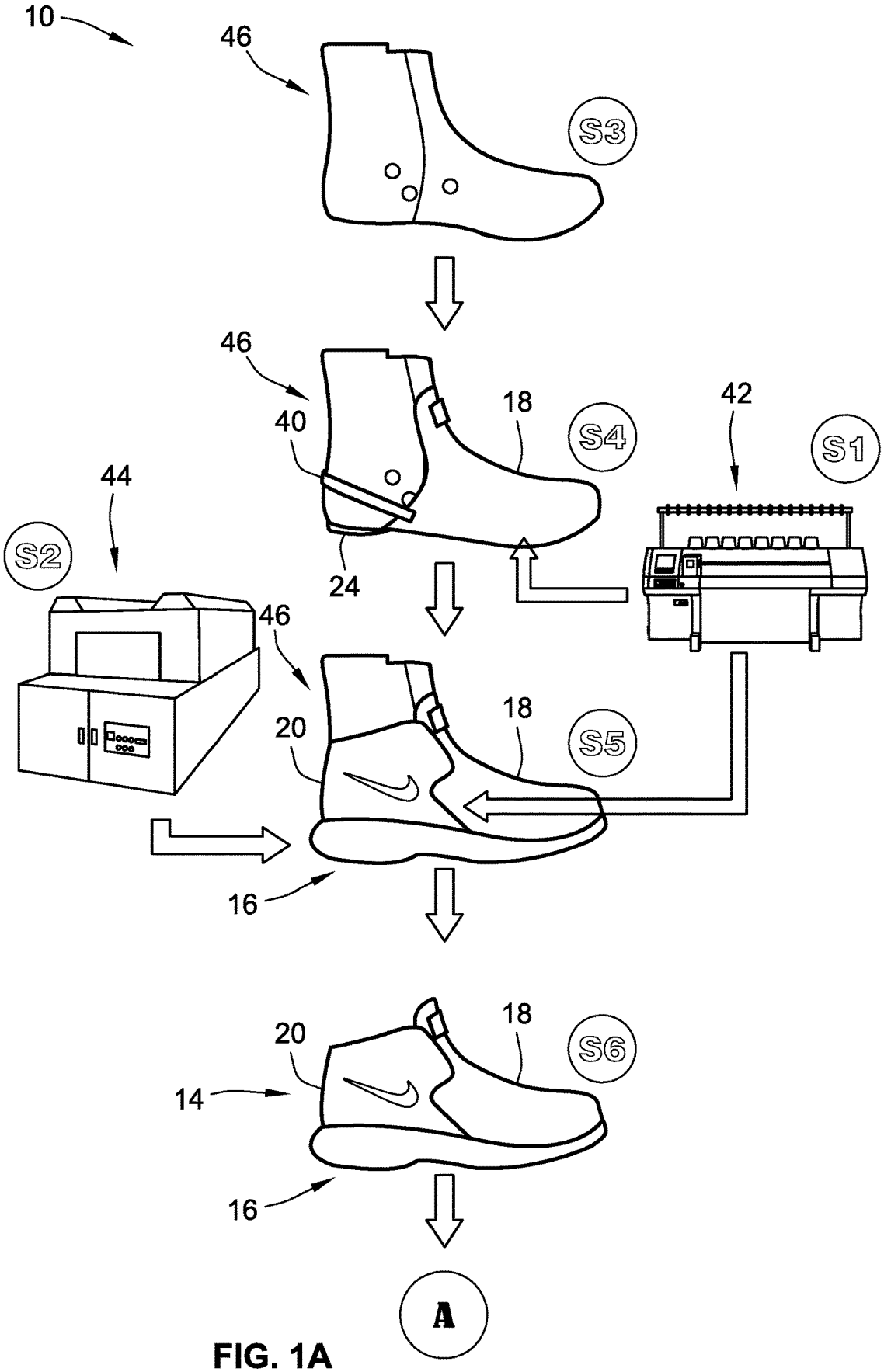
FIGS. 1A and 1B are workflow diagrams schematically illustrating a representative system and process for manufacturing an article of footwear using a sacrificial strap in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the above-enumerated drawing. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad aspects of the disclosure. To that extent, elements and limitations that are described, for example, in the Abstract, Technical Field, Background, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including" and "comprising" and "having" shall each mean "including without limitation." Moreover, words of approximation, such as "about," "almost," "substantially," "generally," "approximately," and the like, may be used herein in the sense of "at, near, or nearly at," or "within 0-5% of," or "within acceptable manufacturing tolerances," or any logical combination thereof, for example. Lastly, directional adjectives and adverbs, such as fore, aft, medial, lateral, proximal, distal, vertical, horizontal, front, back, left, right, etc., may be with respect to an article of footwear when worn on a user's foot and operatively oriented with the base of the sole structure seated on a flat surface, for example.

Figure 1B:
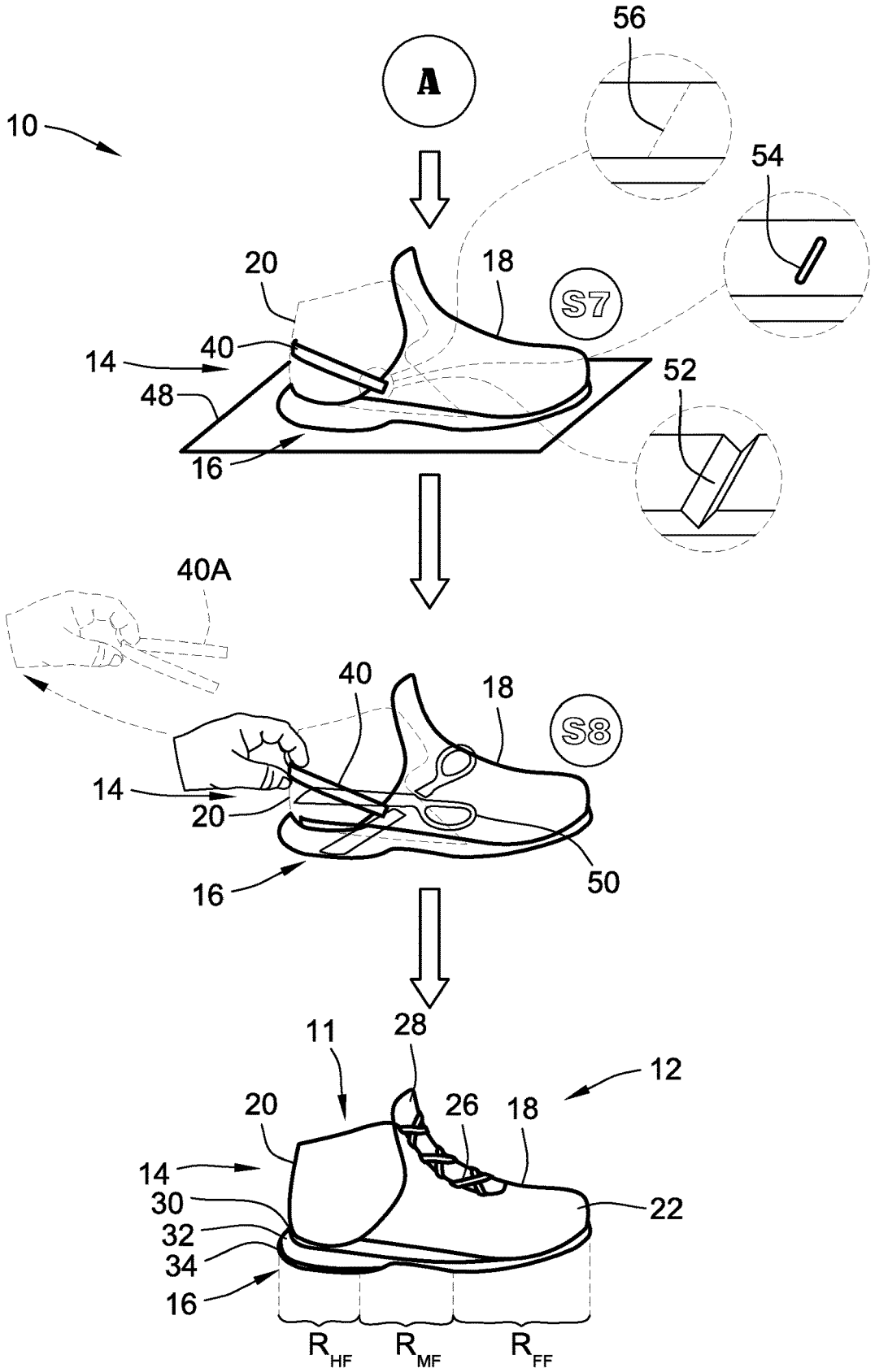

Referring now to the drawings, wherein like reference numbers refer to like features throughout the several views, FIGS. 1A and 1B illustrate a representative manufacturing system and attendant manufacturing process, collectively designated at 10 in the Figures, for constructing an article of footwear, which is designated generally at 12 in FIG. 1B and portrayed herein for purposes of discussion as an athletic shoe or "sneaker." The illustrated footwear 12—also referred to herein as "shoe" for brevity—is merely an exemplary application with which novel aspects and features of this disclosure may be practiced. In the same vein, implementation of the present concepts into the illustrated manufacturing system architecture should be appreciated as a representative application of the disclosed concepts. It should therefore be understood that aspects and features of this disclosure may be incorporated into other manufacturing systems and processes, and may be implemented to construct any logically relevant type of footwear. As used herein, the terms "shoe" and "footwear," including permutations thereof, may be used interchangeably and synonymously to reference any relevant type of garment worn on a human foot. Lastly, the features presented in the drawings are not necessarily to scale and are provided purely for instructional purposes. Thus, the specific and relative dimensions shown in the drawings are not to be construed as limiting.

The representative article of footwear 12 is depicted in FIGS. 1A and 1B as a bipartite construction that is generally composed of a foot-receiving upper 14 mounted on top of a subjacent sole structure 16. For ease of reference, footwear 12 may be divided into three anatomical regions: a forefoot region $R_{FF}$, a midfoot region $R_{MF}$, and a hindfoot (heel) region $R_{HF}$, as shown in FIG. 1B. Footwear 12 may also be divided into a lateral side, which is portrayed at the bottom of FIG. 1B, and a medial side (not visible in the views provided) opposite the lateral side. In accordance with recognized anatomical classifications, the forefoot region $R_{FF}$ is located at the front of the footwear 12 and generally corresponds with the phalanges (toes), metatarsals, and any interconnecting joints. Interposed between the forefoot and hindfoot regions $R_{FF}$ and $R_{HF}$ is the midfoot region $R_{MF}$, which generally corresponds with the cuneiform, navicular and cuboid bones (i.e., the arch area of the foot). Heel region $R_{HF}$, in contrast, is located at the rear of the footwear 12 and generally corresponds with the talus and calcaneus bone. Both lateral and medial sides of the footwear 12 extend through all three anatomical regions $R_{FF}$, $R_{MF}$, $R_{HF}$, and each corresponds with a respective lateral segment of the footwear 12. While only a single shoe 12 for a right foot of a user is shown in the drawings, a mirrored, substantially identical counterpart for a left foot of a user may be produced in accordance with the disclosed techniques. Recognizably, the shape, size, material composition, and method of manufacture of the shoe 12 may be varied, singly or collectively, to accommodate any conventional and nonconventional applications.

With continuing reference to FIG. 1B, the upper 14 is depicted as having a closed heel and toe configuration that is generally defined by a forward vamp 18 and a rearward heel counter 20. According to the illustrated example, the vamp 18 segment of the upper 14 is located in the forefoot and midfoot regions $R_{FF}$ and $R_{MF}$ of the footwear 12, and includes an integral toe box 22. With this design, the vamp 18 of FIGS. 1A and 1B effectively defines the front and center parts of the shoe's upper 14, covering and protecting the foot from the toes to the ankle. Heel counter 20 is located aft of the vamp 18 and includes the rear and rear sides of the upper 14 that cover the foot from the ankle to the heel. Closing off the undersides of the vamp 18 and heel counter 20 is a strobel 24 sheet material that is sewn or otherwise affixed to the lower perimeter of the upper 14, e.g., to facilitate lasting and other fabrication processes. While portrayed in the drawings as comprising three primary segments, namely the vamp 18, heel counter 20, and strobel 24, the upper 14 may be fabricated as a single-piece construction or may be composed of any number of segments, including a toe cap, heel cap, ankle cuff, interior liner, etc.

The upper 14 portion of the footwear 12 may be fabricated from any one or combination of a variety of materials, such as textiles, engineered foams, polymers, natural and synthetic leathers, etc. Individual segments of the upper 14, once cut to shape and size, are stitched, adhesively bonded, welded, or otherwise joined together to form an interior void for comfortably receiving a foot. The individual material elements of the upper 14 may be selected and located with respect to the footwear 12 in order to impart properties of durability, air-permeability, wear-resistance, flexibility, and comfort, for example. An ankle opening 11 (FIG. 1B) in the rear quarter of the upper 14 provides access to the interior of the assembled shoe 12. A shoelace 26, strap, buckle, or other conventional mechanism may be utilized to modify the girth of the upper 14 to more securely retain the foot within the interior of the shoe 12 as well as to facilitate entry and removal of the foot into and from the upper 14. Lace 26 may be threaded through a series of eyelets in the upper 14; a tongue 28 may extend between the lace 26 and the interior void of the upper 14.

Sole structure 16 is rigidly secured to the upper 14 such that the sole structure 16 extends between the upper 14 and a support surface upon which a user stands, for example. In effect, the sole structure 16 functions as an intermediate support platform that separates the user's foot from the ground. In addition to attenuating ground reaction forces and providing cushioning for the foot, sole structure 16 of FIG. 1 may provide traction, impart stability, and help to limit various foot motions, such as inadvertent foot inversion and eversion. While portrayed in the drawings as a multi-layered "sandwich" assembly, the shoe's sole structure 16 may be fabricated as a single-piece construction or may be composed of any number of additional segments.

In accordance with the illustrated example, the sole structure 16 is fabricated as a sandwich structure with a top-most insole 30, an intermediate midsole 32, and a bottom-most outsole 34. Insole 30 is shown located partially within the interior void of the footwear 12, firmly secured to a lower portion of the upper 14, such that the insole 30 is located adjacent a plantar surface of the foot. Underneath the insole 30 is a midsole 32 that incorporates one or more materials or embedded elements that enhance the comfort, performance, and/or ground-reaction-force attenuation properties of footwear 12. These elements and materials may include, individually or in any combination, a polymer foam material, such as polyurethane or ethylene-vinyl acetate (EVA), filler materials, moderators, air-filled bladders, plates, lasting elements, or motion control members. Outsole 34, which may be absent in some configurations of footwear 12, is secured to a lower surface of the midsole 32. The outsole 34 may be formed from a rubber material that provides a durable and wear-resistant surface for engaging the ground.

In addition, outsole 34 may also be textured to enhance the traction (i.e., friction) properties between footwear 12 and the underlying support surface.

A variety of techniques, elective processes, and system architectures may be utilized to manufacture the athletic shoe 12. An example of a footwear manufacturing system 10 and attendant workflow process that incorporates the use of one or more sacrificial straps 40 to fabricate an article of footwear 12 are set forth in FIGS. 1A and 1B. Only select components of the manufacturing system 10 have been shown by way of example in the drawings and will be described in detail hereinbelow. Nevertheless, the manufacturing system 10 of FIGS. 1A and 1B can include numerous additional and alternative fabrication procedures, as well as other available work cells and equipment, without departing from the intended scope of this disclosure. It should also be recognized that the order of execution of the illustrated operations may be changed, additional operations may be added, and some of the operations described may be modified, combined, or eliminated.

Initial stages of the manufacturing process may comprise supplying, accessing, and/or utilizing (collectively "providing") the various materials, tools and machines needed to manufacture the athletic shoe 12. By way of non-limiting example, the representative footwear manufacturing system 10 of FIG. 1A employs a flat machine 42 at step S1 for cutting discrete segments of the upper 14 and, for some system architectures, closing sections of the upper 14 via sewing or other suitable joining technique. At step S2, a molding machine 44 forms a single-layer sole or a multi-layered sole structure 14 through an apposite methodology, such as injection, compression, or vacuum molding, extrusion and cutting, stamping, etc. Step S3 utilizes a manufacturing fixture, portrayed in the drawings as a shoe last 46, to provide a working mold surface for shaping the upper 14 and joining the various shoe structure segments to provide an assembled, substantially finished shoe 12. Each of the aforementioned operations may be automated, e.g., through a central system controller or distributed network of machine controllers, or may be carried out manually, e.g., through conventional methods of clicking, cutting, sewing, surface treating, hand lasting, foxing, welting, etc.

Shoe last 46 of FIG. 1A takes on the general shape of a human foot as well as portions of the adjoining ankle. Although depicted as having a solid, one-piece construction, last 46 may also be hollow, may be formed from multiple interconnected elements, and may comprise movable features that vary the overall shape and size of the lasting surface. In the same vein, the shape, size and/or material composition of the last 46 may be modified from those shown in the drawings to accommodate different shoe sizes, types, or other intended application. Flat machine 42 of FIG. 1A produces multiple segments of the upper 14, including the forward vamp 18 (representative of a "first segment") and the rearward heel counter 20 (representative of a "second segment"), for assembly on the last 46. An impermanent strap or sling may be incorporated into one or more of all of the shoe structure segments to temporarily secure those segments to the last 46 during assembly of the shoe 12. According to the illustrated example, opposing longitudinal ends of a sacrificial heel strap 40 are attached proximate respective rear edges of the vamp 14. Sacrificial strap 40 of FIGS. 1A and 1B is limited to an elongated and flexible single-piece strip of material that is bonded or stitched to the vamp 14 just above the welt line. It is envisioned, however, that the sacrificial strap 40 may comprise multiple interconnected pieces and, optionally, may originate or terminate at other locations on the vamp 14. To reduce material costs without undermining the functional integrity of the sacrificial heel strap 40, the strap 40 may be formed from a durable and elastic material that is less expensive, structurally inferior to, and less aesthetically appealing than the materials used to form the other segments of the upper 14.

During assembly of the athletic shoe 12, the vamp 18 segment of the upper 14 is loosely placed on a complementary forward section of the last 46 (e.g., that section associated with the forefoot and midfoot regions $R_{FF}$ and $R_{MF}$ and extending over the extensor hallucis and extensor digitorum ligaments of the foot), as indicated at step S4. Strobel 24 is concomitantly stretched across the underside surface of the last 46, which may generally correspond to the plantar surface of the foot, as seen in FIG. 1A. Prior to placing the heel counter 20 segment of the upper 14 on the last 46, the vamp 18 and strobel 24 are temporarily secured in place by pulling the sacrificial strap 40 aft towards the rear of the last 46, and positioning the sacrificial strap 40 around and against the Achilles tendon section of the last 46. In so doing, the vamp 18 and strobel 24 are securely retained in place without the need for adhesives or two-sided tape or a pin, clip, shim, or other mechanical device. After securely attaching the vamp 18 and strobel 24 to the last 46, the heel counter 20 is placed on a complementary rearward section of the last 46 (e.g., that section associated with the hindfoot region $R_{HF}$ and extending around the calcaneus bone and Achilles tendon), as indicated at step S5. At this time, heel counter 20 is rigidly attached to the vamp 18 and strobel 24 by any suitable means available. The sole structure 16 is secured to both the vamp 18 and heel counter 20 segments of the upper 14. Once the upper 14 is assembled, mounted on the sole structure 16, and lasted on the last 46, the shoe 12 is removed from the last, as indicated at step S6.

Turning next to FIG. 1B, the sacrificial strap 40 may be permanently detached from the shoe 12 upon completion of the assorted manufacturing processes associated with the last 46 and upon removal of the shoe 12 from the last 46. In accord with the illustrated example, step S7 of FIG. 1B may include securing the unfinished shoe 12 to a work bench or transfer fixture (collectively designated 48). The sacrificial heel strap 40 is then severed from the upper 14 by cutting the longitudinal ends of the strap 40 off of the vamp 18, as indicated at step S8. To facilitate this operation, the sacrificial strap 40 may be fabricated from a polymeric material (e.g., low-density polyethylene) and/or a textile material (e.g., nonwoven cotton) that is constructed to be manually cut with a pair of scissors 50. As another option, the sacrificial strap 40 may be fabricated with a reduced-thickness section 52 and/or a slotted section 54 that is designed to be readily cut. Alternatively, disconnecting the sacrificial heel strap 40 from the upper 14 may merely involve tearing the longitudinal ends of the strap 40 from the aft end of the vamp 18. To facilitate this operation, the sacrificial strap 40 may be fabricated from a frangible material (e.g., loose-knit, low-thread-count cotton) that is easy to tear by hand. As another option, the sacrificial strap 40 may be fabricated with a tear seam 56 with a series of apertures and/or micro-slots configured to be readily torn. The severed strap 40A is thereafter discarded, recycled, or reused for fabricating another article of footwear.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A method for manufacturing an article of footwear, the method comprising:

providing a first segment of an upper configured to attach to a foot of a user, the upper including a sacrificial strap attached at opposing ends thereof to the first segment;

placing the first segment of the upper on a manufacturing fixture;

attaching the first segment to the manufacturing fixture by positioning the sacrificial strap against the manufacturing fixture;

attaching a second segment of the upper to the first segment;

removing the first and second segments from the manufacturing fixture; and disconnecting the sacrificial strap from the upper, wherein disconnecting the sacrificial strap from the upper includes cutting the sacrificial strap off of the first segment.

2. The method of claim 1, wherein the sacrificial strap is fabricated from a polymeric material and/or a textile material configured to be readily cut.

3. The method of claim 1, wherein the sacrificial strap includes a reduced-thickness section and/or a slotted section configured to be readily cut.

4. The method of claim 1, wherein the first segment includes a first material and the sacrificial strap includes a second material distinct from the first material.

5. The method of claim 1, wherein the sacrificial strap consists essentially of an elongated, flexible, single-piece strip of material bonded or stitched to the first segment.

6. The method of claim 1, wherein the first segment includes a vamp segment of the upper.

7. The method of claim 6, wherein the first segment further includes a strobel segment attached to the vamp segment.

8. The method of claim 6, wherein the second segment includes a heel counter segment of the upper.

9. The method of claim 1, further comprising:

providing a sole structure configured to support thereon the foot of the user, the sole structure having an outsole defining a ground-engaging portion of the footwear; and attaching the sole structure to the first segment prior to removing the first and second segments from the manufacturing fixture.

10. A method for manufacturing an article of footwear, the method comprising:

providing a first segment of an upper configured to attach to a foot of a user, the upper including a sacrificial strap attached at opposing ends thereof to the first segment;

placing the first segment of the upper on a manufacturing fixture;

attaching the first segment to the manufacturing fixture by positioning the sacrificial strap against the manufacturing fixture;

attaching a second segment of the upper to the first segment;

removing the first and second segments from the manufacturing fixture; and disconnecting the sacrificial strap from the upper, wherein disconnecting the sacrificial strap from the upper includes tearing the sacrificial strap off of the first segment.

11. The method of claim 10, wherein the sacrificial strap is fabricated from a frangible material configured to be readily torn.

12. The method of claim 10, wherein the sacrificial strap includes a tear seam with a series of apertures and/or a series of micro-slots.

13. The method of claim 10, wherein the sacrificial strap includes a flexible polymeric material and/or a flexible textile material.

14. The method of claim 10, wherein the sacrificial strap includes a reduced-thickness section and/or a slotted section configured to be readily torn.

15. The method of claim 10, wherein the first segment includes a first material and the sacrificial strap includes a second material distinct from the first material.

16. The method of claim 10, wherein the sacrificial strap consists essentially of an elongated, flexible, single-piece strip of material bonded or stitched to the first segment.

17. The method of claim 10, further comprising:

providing a sole structure configured to support thereon the foot of the user, the sole structure having an outsole defining a ground-engaging portion of the footwear; and attaching the sole structure to the first segment prior to removing the first and second segments from the manufacturing fixture.

18. A method for manufacturing an article of footwear, the method comprising:

providing a first segment of an upper configured to attach to a foot of a user, the upper including a sacrificial strap attached at opposing ends thereof to the first segment, the sacrificial strap including a flexible polymeric material and/or a flexible textile material;

placing the first segment of the upper on a manufacturing fixture;

attaching the first segment to the manufacturing fixture by positioning the sacrificial strap against the manufacturing fixture;

attaching a second segment of the upper to the first segment;

removing the first and second segments from the manufacturing fixture; and disconnecting the sacrificial strap from the upper by cutting, tearing, or severing the sacrificial strap.

19. The method of claim 18, wherein disconnecting the sacrificial strap from the upper includes cutting the sacrificial strap off of the first segment.

20. The method of claim 18, wherein disconnecting the sacrificial strap from the upper includes tearing the sacrificial strap off of the first segment.

* * * * *